United States Patent [19]

Biegel

[11] Patent Number: 4,508,197

[45] Date of Patent: Apr. 2, 1985

[54] HANDBRAKE SYSTEM FOR RAILWAY CAR

[75] Inventor: Robert A. Biegel, Dolton, Ill.

[73] Assignee: Thrall Car Manufacturing Company, Chicago Heights, Ill.

[21] Appl. No.: 537,799

[22] Filed: Sep. 30, 1983

[51] Int. Cl.[3] ..... B61H 13/00

[52] U.S. Cl. ..... 188/47; 188/52; 188/198

[58] Field of Search ..... 188/47, 52–55, 188/107, 49–51, 197–203, 207, 217

[56] References Cited

U.S. PATENT DOCUMENTS 4,346,790 8/1982 Morrison et al. ..... 188/47

4,422,532 12/1983 Cordani et al. ..... 188/52 X

*Primary Examiner*—Douglas C. Butler

*Attorney, Agent, or Firm*—Marshall, O'Toole, Gerstein, Murray & Bicknell

[57] ABSTRACT

This disclosure relates to a handbrake system for a railway car, such as an articulated car, having at least first, second and third trucks, each truck having a handbrake mechanism. The system comprises a handbrake and a force distributor including an input branch and first and second output branches. The system further comprises a first linkage connecting the handbrake to the input branch for moving the distributor when the handwheel is turned, a second linkage from the first output branch to the brake mechanism of the first truck, an automatic slack adjuster, a third linkage from the second output branch to the slack adjuster, a fourth linkage from the slack adjuster to the brake mechanism of the second truck, and a fifth linkage from the slack adjuster to the brake mechanism of the third truck.

14 Claims, 7 Drawing Figures

HANDBRAKE SYSTEM FOR RAILWAY CAR

This invention relates to brake systems for railway cars, and more particularly to a handbrake system for a railway car having three or more trucks.

BACKGROUND OF THE INVENTION

Railway cars having three or more trucks, such as articulated railway cars, have become increasingly common in recent years and are particularly useful for carrying trailers and containers. Articulated cars of this type include a series of car units, the outermost ends of the end units having conventional couplers and trucks, and the intermediate ends having semi-permanent articulated connections and trucks that are common to two adjacent ends. U.S. Pat. Nos. 4,233,909 and 4,346,790 show cars of this nature.

Federal regulations and the railway industry require that railway cars be equipped with handbrakes, and that the braking force be at least 11% of the total weight of the loaded car. For articulated cars, it would be expensive and inconvenient to place a handbrake on every unit, but at the same time a handbrake for two trucks of only one unit could not apply the required braking force.

To overcome these problems, the construction described in U.S. Pat. No. 4,346,790 includes a single handbrake wheel which is connected by chains and rods to operate brakes on three trucks of a car. While a system of this nature may be able to satisfy the braking force requirement, it has two important disadvantages. First, the interconnections, as shown in the patent, between the brakes of the multiple trucks raises the possibility that a jam at one point in the brake system may prevent movement of the rods and make the entire handbrake system inoperable. Second, the system operates the brakes of three trucks but requires two automatic slack adjusters, which makes the system relatively expensive.

It is a general object of the present invention to provide an improved handbrake system which avoids the foregoing problems.

SUMMARY OF THE INVENTION

This invention relates to a handbrake system for a railway car having at least first, second and third trucks and each truck having a handbrake mechanism, the system comprising a handwheel and a force distributor including an input branch and first and second output branches. The system further comprises a first linkage connecting said handwheel to said input branch for moving the distributor when the handwheel is turned, a second linkage from said first output branch to the brake mechanism of the first truck, an automatic slack adjuster, a third linkage from the second output branch to said slack adjuster, a fourth linkage from said slack adjuster to the brake mechanism of the second truck, and a fifth linkage from the slack adjuster to the brake mechanism of the third truck.

BRIEF DESCRIPTION OF THE DRAWINGS

The foregoing and other objects and advantages of the present invention will become more apparent from the following detailed description taken in conjunction with the accompanying figures of the drawings, wherein.

DETAILED DESCRIPTION OF THE DRAWINGS

Figures 1, 3:
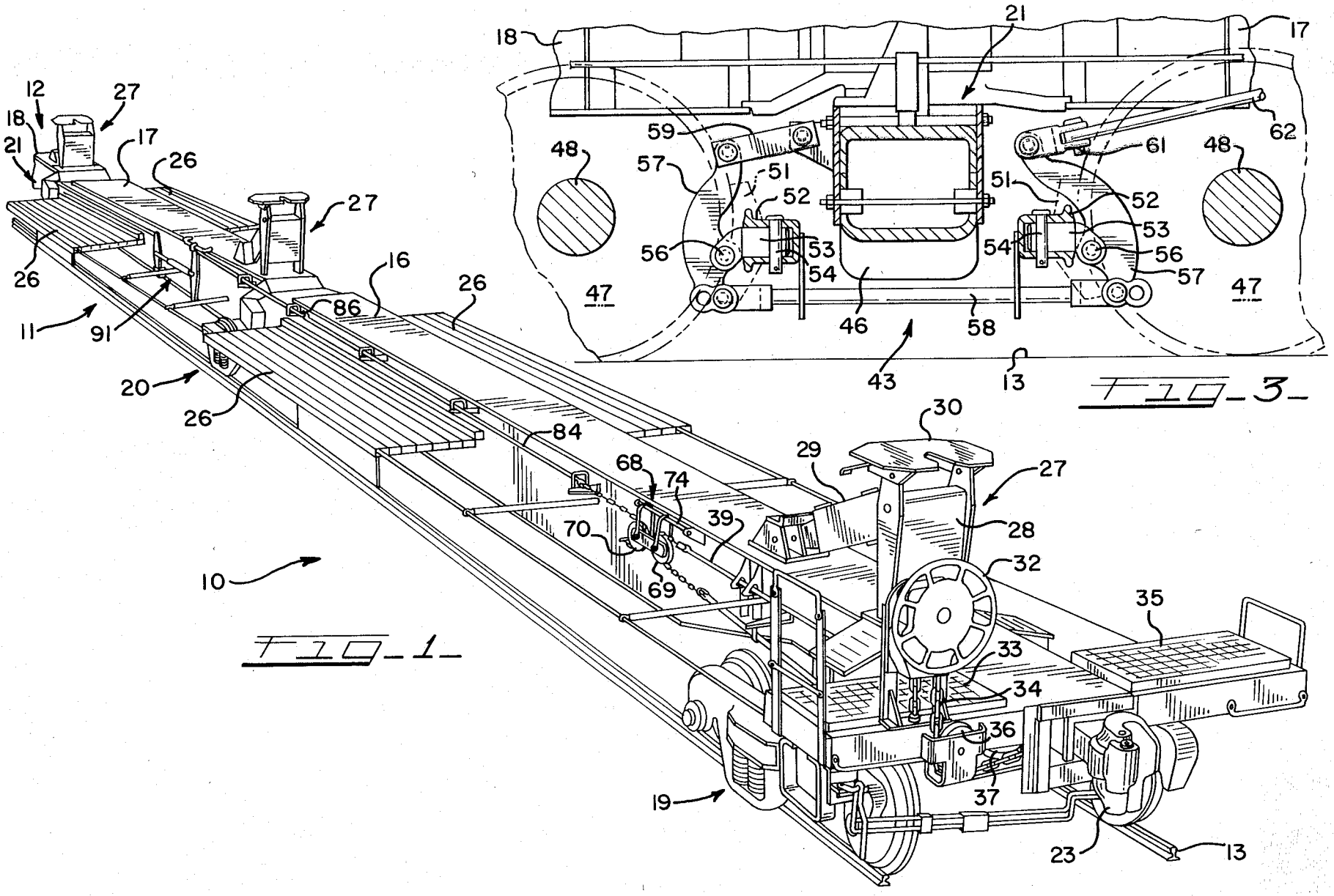
FIG. 1 is a perspective view of part of an articulated railway car embodying the present invention.
FIG. 3 is an enlarged view partially in section of part of a truck of the car shown in FIG. 1.

FIG. 1 illustrates part of an articulated car including a series of car units 10, 11 and 12 which are located on conventional railway tracks 13. The cars include center sills 16, 17 and 18, respectively, which are supported at their ends by trucks 19, 20 and 21. The truck 19 is at the outermost end of the end unit 10 of the car whereas the trucks 20 and 21 are intermediate trucks located between adjacent ends of the car units 10, 11 and 12. The adjacent ends of the units, which are above the trucks 20 and 21, are pivotally connected by articulated connectors fastened to the trucks and common to both ends of adjacent units. The articulated connectors may have a conventional construction, and the outermost ends of the end units may be equipped with conventional semi-automatic couplers 23.

In the specific example being described, the units 10, 11 and 12 are designed to carry trailers, and for this purpose platforms 26 are mounted adjacent one end of the center sill of each unit. The platforms 26 are supported by cross-bearers that extend laterally from and are secured to the center sill. The platforms 26 are designed to support the wheels of a trailer, and the opposite end of each unit is equipped with a support 27 for the hitch of a trailer. The support 27 includes a generally vertical pedestal 28 and an angled support 29, both of which are pivotally attached to the center sill of the unit and which support a plate or platform 30.

Figure 4:
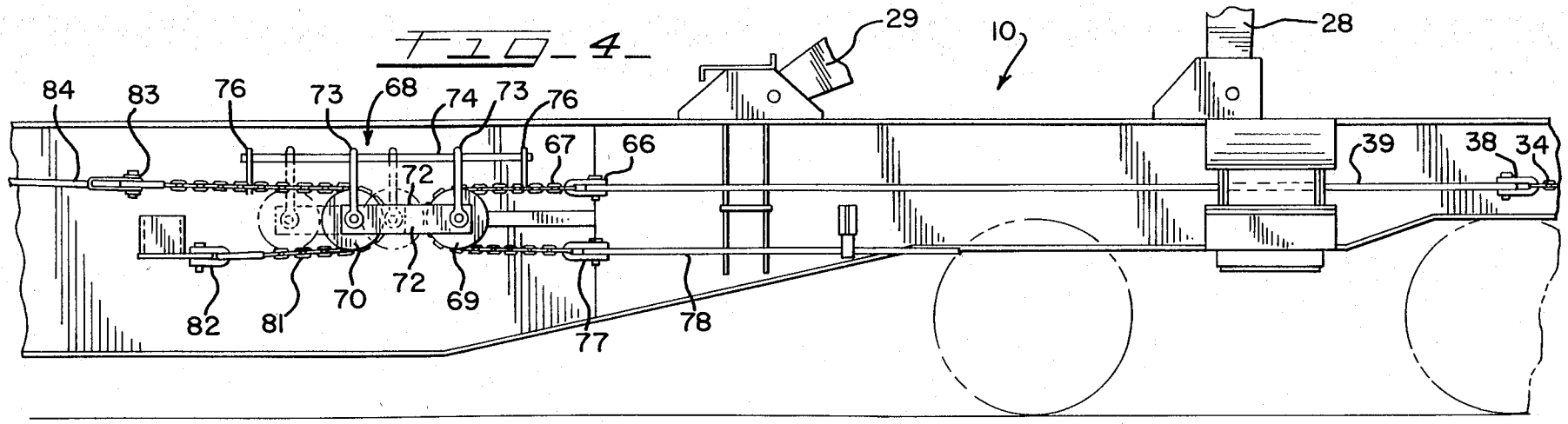
FIG. 4 is a fragmentary view of part of the car.

The outermost end of the end unit 10 further supports a handbrake mechanism 33 including a handwheel 32 that is rotatably mounted on a vertical stand. The stand is secured to a safety platform 35 that is mounted on the center sill 16. Attached to the handbrake 33 and rotatable with it is a gear (not shown) which has a chain 34 wound around it. The chain 34 is looped around additional sheave wheels 36 and 37 and its outer end is attached by a clevis and pin connection 38 (FIG. 4) to a rod 39. To operate the handbrake system, as will be described in more detail hereinafter, a train operator turns the handwheel 32 in order to take up the chain 34 on the gear attached to the handwheel, and thereby pull the chain 34 and the rod 39 toward the right as seen in FIGS. 1 and 4. The handbrake is released by turning the handwheel 32 in the opposite direction in order to unwind the chain 34 and enable the chain 34 and the rod 39 to move toward the left as seen in FIGS. 1 and 4.

Figures 2, 6, 7:
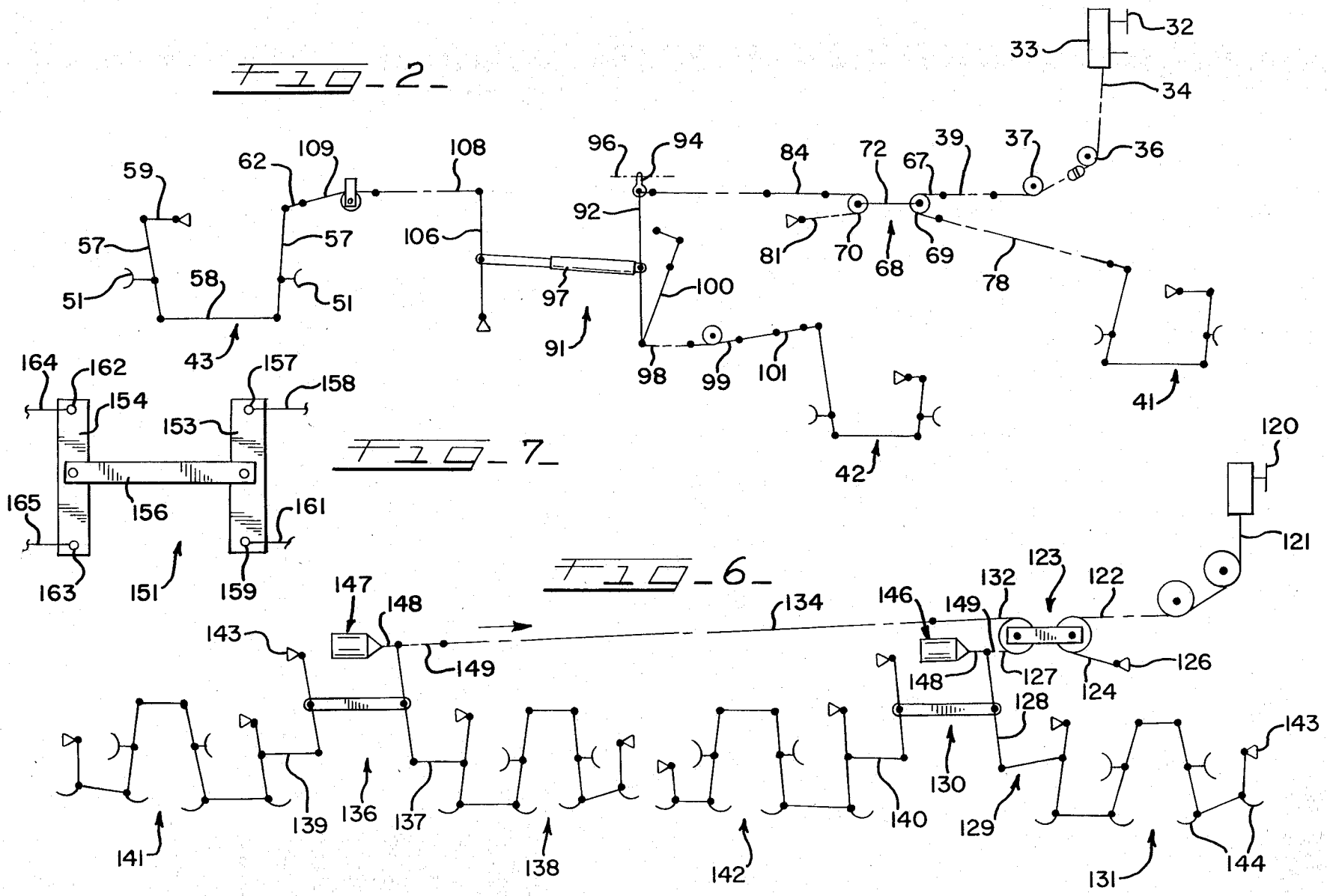
FIG. 2 is a schematic diagram showing a handbrake system of the car shown in FIG. 1.
FIG. 6 is a schematic view similar to FIG. 2 but showing an alternative form of a handbrake system.
FIG. 7 is a view of an alternative form of a force distributor of the system.

Each truck 19, 20 and 21 is provided with a handbrake mechanism which is shown schematically in FIG. 2. With reference to FIG. 2, the brake mechanism for the truck 19 is indicated by the numeral 41, the mechanism for the truck 20 is indicated by the numeral 42, and the mechanism for the truck 21 is indicated by the numeral 43. The handbrake system in accordance with the present invention is designed to operate the three brake mechanisms 41, 42 and 43 utilizing the single handbrake 33.

FIG. 3 illustrates in more detail parts of the handbrake mechanism 43 for the truck 21 between the units 11 and 12, and the construction of the mechanism 43 is representative of the constructions of the mechanisms 41 and 42. The truck 21 includes a bolster 46 which extends laterally of the sill and has its ends supported by side frames (not shown). Wheels 47 of the truck are mounted on laterally extending axles 48 which are connected to the side frames and thereby support the bolster 46. The upper side of the bolster supports the articulated connector than joins the center sills 17 and 18 of the two units 11 and 12.

The brake mechanism includes brake shoes 51 that are adapted to frictionally engage the wheels 47. The brake shoes are fastened to two brake beams 52, there being two brake beams and a brake shoe connected to each end of each beam. The two beams 52 are attached to fulcrum brackets 53 by pins 54, and the brackets 53 are pivotally attached by pins 56 to handbrake levers 57. The pins 56 are attached to generally central portions of the levers 57, and the lower ends of the levers 57 are pivotally connected together by a connecting rod 58. The upper end of the left (as seen in FIG. 3) lever 57 is pivotally connected by a link 59 to the bolster 46, thereby anchoring the upper end of the left lever 57. The upper end of the right-hand lever 57 is pivotally connected by a clevis and pin connection 61 to a rod 62.

To engage the handbrake, the rod 62 is moved toward the right, as seen in FIG. 3, thereby pulling the upper end of the right lever 57 and the associated beam 52 toward the right. This action also moves the lower end of the right lever 57 toward the left and shifts the connecting rod 58 toward the left, thereby causing the left lever 57 to pivot in the clockwise direction about its upper anchor pin. These movements cause the two brake beams 52 to spread apart and force the brake shoes 51 against the outer surfaces of the wheels in order to apply a braking force. The handbrake is disengaged by allowing the rod 62 to move toward the left, as seen in FIG. 3, thereby relieving the above described forces which move the brake shoes against the wheels.

Figure 5:
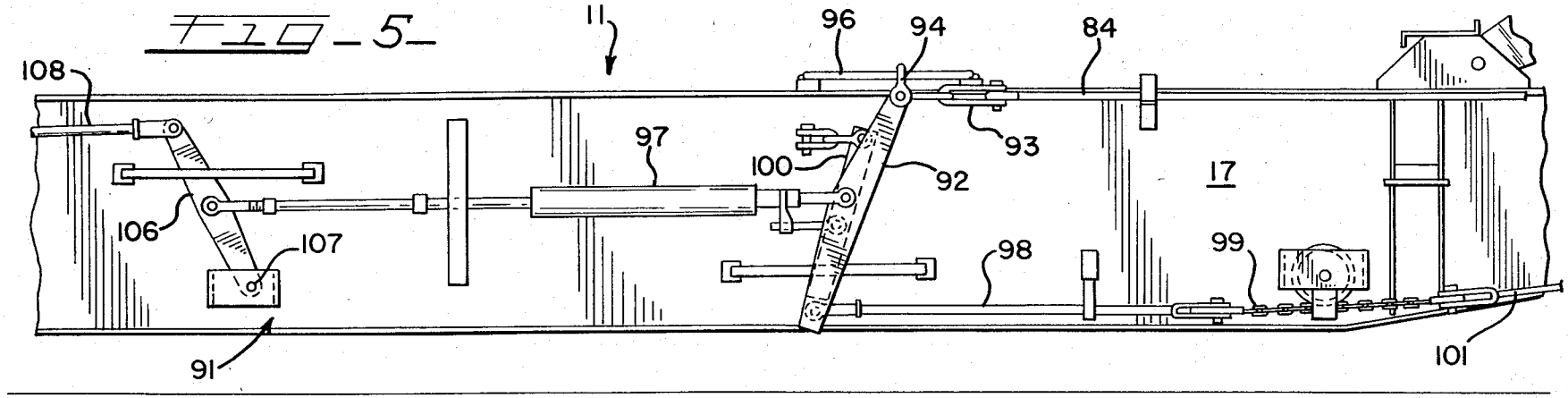
FIG. 5 is a fragmentary view of another part of the car.

The system for operating the handbrake mechanisms from the handwheel 32 is shown schematically in FIG. 2 and in detail in FIGS. 4 and 5. With reference to FIG. 2, the handwheel 32, the chain 34 and the rod 39 are schematically illustrated. The chain 34 is passed around sheave wheels 36 and 37 and connected to the rod 39 as previously described. The left end of the rod 39 is pivotally connected by a clevis and pin connection 66 to a chain 67 which forms part of a force distributor 68. In the present illustration, the distributor 68 is formed by a trolley including two sheave wheels 69 and 70 which are rigidly interconnected by a support 72. The wheels 69 and 70 are rotatably mounted on the support 72, and a slide support 73 having the shape of an inverted "U" is connected to the support 72 and looped over a slide support rod 74. The rod 74 is attached by brackets 76 to the adjacent side of the sill 16 and the rod 74 supports the trolley wheels 69 and 70 for movement in the longitudinal direction along the length of the sill.

The previously mentioned chain 67 is looped around the wheel 69 and is connected by a clevis and pin connection 77 to another rod 78 that extends to the brake mechanism 41 of the truck 19, as shown in FIGS. 1 and 2. Another chain 81 is looped around the other wheel 70, and one end of the chain 81 is anchored to the side of the sill 16 by a clevis and pin connection 82. The other end of the chain 81 is attached by a similar connection 83 to a rod 84 which extends from the car 10 to the car 11. As shown in FIG. 1, the rod 84 extends across the connected ends of the cars 10 and 11 and above the truck 20, and interconnected loops 86 in the rod 84 enable the rod to pivot adjacent the articulated connection.

With reference to FIGS. 1, 2 and 5, the left (as seen in FIGS. 1, 2 and 5) end of the rod 84 is connected to an automatic slack adjusting mechanism 91 that includes a floating lever 92 which has its upper end pivotally connected to the rod 84 at the point indicated by the numeral 93. The upper end of the lever 92 is slideably supported on the sill 17 of the unit 11 by a loop 94 and a slide support rod 96 that is secured to the sill 17. Thus, when the rod 84 is moved longitudinally of the sill 17, the upper end of the lever 92 and the loop 94 also move relative to the sill. At the center area of the lever 92, a slack adjuster 97 is pivotally connected to it by a pivot pin, and the lower end of the lever 92 is pivotally connected to another rod 98 and to a trigger lever 100. The rod 98 extends toward the right in the direction of the truck 20, and the rod 98 is connected by a chain 99 and a rod 101 to the brake mechanism 42. The construction of the brake mechanism 42 and its operation are similar to the brake mechanism 41 shown and described in connection with FIG. 3. The only difference is that the right-hand brake lever for the mechanism 42 is anchored to the bolster of the truck 20 and the operating rod 10 is connected to the left-hand brake lever of the mechanism.

The slack adjuster 91 is further connected to operate the brake mechanism 43 of the truck 21, and to this end the left-hand end of the adjuster 97 is connected to a lever 106 that has its lower end anchored by a pin 107 to the adjacent side of the sill 17. The upper end of the lever 107 is pivotally connected to a rod 108 and by a chain 109 (see FIG. 2) to the rod 62 previously described in connection with the brake mechanism 43 of the truck 21 (FIG. 3).

To operate the handbrake mechanism, the handwheel 32 is turned as previously mentioned to draw the chain 34 and the rod 39 toward the right as seen in FIG. 2. The force or pull exerted by the handwheel causes the trolley wheel 69 to move toward the right slightly and to pull the rod 78 (FIGS. 2 and 4) toward the left and thereby operate the brake mechanism 41. The force exerted by the rod 39 tending to move the wheel 69 toward the right also exerts a force through the force distributor 68 to the chain 81 and the rod 84 which moves the rod 84 toward the right as seen in FIGS. 2, 4 and 5. This action operates through the slack adjuster 91 to move the rod 98 to the left and thereby operate the brake mechanism 42, and to move the rod 108 toward the right and thereby operate the brake mechanism 43. The handbrake is, of course, disengaged simply by turning the handwheel 32 in the opposite direction and enabling the foregoing parts to move in the opposite direction.

It will be apparent that the linkage formed by the chain 34 and the rod 39 is connected to an input branch of the force distributor 68. An output branch of the distributor 68 is connected by a linkage to the brake mechanism 41, and another output branch is connected to a linkage leading to the slack adjuster. The handbrake mechanism 41 is operated through distributor 68 independently of the operation of the other two mechanisms 42 and 43. In other words, even if one of the two mechanisms 42 or 43, or the linkages running to them, may become jammed, the brake mechanism 41 will nevertheless be engaged when the handwheel 32 is turned. Similarly, if the brake mechanism 41 or the connecting linkage becomes jammed making the mechanism 41 inoperable, the brake mechanisms 42 and 43 may nevertheless be engaged because the pull exerted by the chain 34 will move the distributor 68 toward the right and exert a pull on the rod 84 in order to operate the mechanisms 42 and 43.

In addition to the foregoing advantage, the force distributor 68 enables the operation of three brake mechanisms from a single handbrake and requiring only a single slack adjuster mechanism, thereby reducing the cost of the system as well as increasing the reliability.

The distributor 68 operates to distribute the force exerted by the handwheel in two or more directions, and the distributed forces are essentially equal. A pull on the rod 39 will cause the brake mechanism 41 to initially engage and then the trolley will move toward the right in order to engage the other two mechanisms 42 and 43. Further, this operation will occur even if some slack develops in the linkages because of brake shoe wear. In FIG. 4, the solid line position of the wheels 69 and 70 shows their positions when the shoes are new and brakes applied, and the dashed line position shows the situation with brakes released. In either case, the distributed forces are essentially equal and the brakes are engaged essentially simultaneously.

The handbrake system illustrated and described in connection with FIGS. 1–5 is especially suited for an arrangement where the handbrake system of the car is mounted on the trucks of the car and the air brake system is separate from the linkages for actuating the handbrake. The system shown in FIG. 6 is an alternate form and is especially suited for an arrangement where the air brake system is mounted on the body of the car and is connected to the linkages of the handbrake system.

With specific reference to FIG. 6, the handbrake system illustrated therein includes a handwheel 120 which is connected by a linkage 121 to an input connection 122 of a force distributor 123. An output connection 124 of the distributor is anchored to the car body at the point 126. Another output connection 127 is connected to a lever 128 of a slack adjuster 130, which, in turn, is connected by linkages 129 to actuate a brake mechanism 131 of a truck. Still another linkage 140 connects the slack adjuster 130 to the brake mechanism 142 of another truck.

A second output connection 132 of the force distributor 123 is connected by a linkage 134 to an automatic slack adjuster 136. The adjuster 136 is connected by one linkage 137 to a brake mechanism 138 of another truck, and still another linkage 139 connects the slack adjuster 136 to the brake mechanism 141 of still another truck.

It will be apparent from the foregoing that the force distributor 123 corresponds generally to the distributor 68 and that the brake mechanisms 131, 138, and 141 correspond to the brake mechanisms 41, 42 and 43. The slack adjuster 136, of course, corresponds to the slack adjuster 91.

The output connection 127 of the distributor 123 is also connected to the slack adjuster 130, and this adjuster is provided in order that the output connection 127 may be coupled to two brake mechanisms rather than one as shown in FIG. 2. The slack adjuster 130 connects the output connection 127 to the second brake mechanism 142 using the linkage 140. The operation of the linkages for operating the slack adjusters and the various brake mechanisms is similar to that described in connection with FIG. 2 and will therefore not be repeated. The triangular symbols, indicated by the numeral 143 in FIG. 6, indicate anchor points for a linkage or lever on the body of the car, and ordinary dots indicate pivot connections between rods and levers. The curved connections indicated by the numeral 144 indicate hook lever connections between the parts.

The air brake system of the car is also connected to the linkages and in the present instance includes a brake cylinder 146 which, when actuated or energized, exerts a force in the rightward direction (as seen in FIG. 6). The air brake system further includes a second cylinder 147 which is connected to the input of the slack adjuster 136. The two air cylinders 146 and 147 have rigid connections between their piston rods 148 and the associated slack adjusters 130 and 136, so that when the cylinders are actuated they move the slack adjusters in order to engage the four brake mechanisms. There is, however, a loose or flexible connection, such as that formed by a chain, between the piston rods 148 and the force distributor 123. These loose connections are indicated by the numeral 149. The effect of the loose connections 149 is that the cylinders 146 and 147 are not able to exert an input force on the force distributor 123 because a compressive force on the loose connections 148 will simply cause these connections to fold or become slack. On the other hand, when the hand-brake system is operated, the loose connections 149 become taut and thus operate the brake mechanisms.

FIG. 7 illustrates an alternative form of force distributor 151 which may be used in place of the distributors 68 and 123. The distributor 151 includes two levers 153 and 154 which are connected together at their midsections by a link or rod 156. One end 157 of the lever 153 forms an input connection and is connected by a linkage 158 to the handbrake. The other end 159 of the lever 153 is connected by a link 161 to either a brake mechanism or to an anchor point, depending upon the particular arrangement chosen. The ends 162 and 163 of the lever 154 also form output connections which are connected by linkages 164 and 165 to brake mechanisms or to anchor points, again depending upon the particular arrangement chosen. The force distributor 151 is mounted on a car so that the levers 153 and 154 and the link 156 may move relative to the car, similar to the arrangement of the trolleys shown in FIGS. 2 and 6.

What is claimed is:

1. A handbrake system for a railway car including at least first, second and third trucks and each truck including a brake mechanism, said handbrake system comprising:

(a) a handbrake with a handwheel;

(b) a force distributor including an input branch, a first output branch and a second output branch;

(c) a first link connecting said handwheel to said input branch for moving said input branch and first and second output branches when said handwheel is moved;

(d) a second link connected to said first output branch and adapted to be connected to the brake mechanism of the first truck;

(e) an automatic slack adjuster;

(f) a third link connected to said second output branch and to said slack adjuster;

(g) a fourth link connected to said slack adjuster and adapted to be connected to the brake mechanism of the second truck; and (h) a fifth link connected to said slack adjuster and adapted to be connected to the brake mechanism of the third truck;

(i) whereby movement of said handwheel operates through said force distributor to separately operate the brake mechanisms.

2. A system according to claim 1, wherein said force distributor comprises first and second movable members and a brace connecting said members, said input and said outputs being connected to said members.

3. A system according to claim 2, wherein said members comprise rotatable wheels, and said input and output comprise flexible members extending at least partially around said wheels.

4. A system according to claim 2, wherein said members comprise levers, and said inputs and outputs comprise connections to end portions of said levers, said brace being connected between said levers.

5. A system according to claim 1, wherein said force distributor comprises first and second wheels, a brace for rotatably supporting said wheels, slide means adapted to slideably support said brace and said wheels on said car, first flexible means extending at least partially around said first wheel, second flexible means extending at least partially around said second wheel, and said first and second flexible means forming said input branch and said first and second output branches.

6. A railway car, comprising:

(a) at least first, second and third trucks;

(b) each of said trucks including a brake mechanism;

(c) a handwheel mounted on one of said units;

(d) a movable force distributor including an input branch, a first output branch and a second output branch;

(e) a first link connecting said handwheel to said input branch for moving said input branch and first and second output branches when said handwheel is moved;

(f) a second link connected to said first output branch and connected to said brake mechanism of the first truck;

(g) an automatic slack adjuster;

(h) a third link connected to said second output branch and to said slack adjuster;

(i) a fourth link connected to said slack adjuster and connected to said brake mechanism of the second truck;

(j) a fifth link connected to said slack adjuster and connected to said brake mechanism of said third truck; and (k) whereby movement of said handwheel operates through said force distributor to separately operate said brake mechanisms.

7. A car according to claim 6, wherein said force distributor connection comprises first and second movable members and a brace connecting said members, said input and said outputs being connected to said members.

8. A car according to claim 7, wherein said members comprise rotatable wheels, and said input and outputs comprise flexible members extending at least partially around said wheels.

9. A car according to claim 6, wherein said force distributor comprises first and second wheels, a brace for rotatably supporting said wheels, slide means adapted to slideably support said brace and said wheels, first flexible means extending at least partially around said first wheel, second flexible means extending at least partially around said second wheel, and said first and second flexible means forming said input branch and said first and second output branches.

10. A car according to claim 9, wherein said handwheel is adjacent said first truck, one end of said first flexible means is connected to said handwheel and the other end of said first flexible means is connected to said brake mechanism of said first truck, one end of said second flexible means is attached to said one unit and the other end of said second flexible means is connected to said slack adjuster.

11. A car according to claim 9, wherein said handwheel is adjacent said first truck, one end of said first flexible means is connected to said handwheel and the other end of said first flexible means is connected to said one unit, one end of said second flexible means is attached to said brake mechanism of said first truck and the other end of said second flexible means is connected to said slack adjuster.

12. A car according to claim 11, and further including a fourth truck and a brake mechanism on said fourth truck, and a second automatic slack adjuster connected to said brake mechanism of said fourth truck, and said one end of said second flexible means further being connected to said slack adjuster.

13. A car according to claim 6, wherein said car includes at least two car units, said first truck being at an outer end of one of said units, said second truck being at the intermediate ends of said units, and said third truck being at the other end of the other of said units, an articulated connection between said intermediate ends, and at least one of said links extending across said articulated connection.

14. A handbrake system for a railway car including at least first, second and third trucks, said handbrake system comprising:

(a) a handbrake mechanism adapted to be mounted on each of said trucks;

(b) a handbrake with a handwheel;

(c) a force distributor including an input branch, a first output branch and a second output branch;

(d) a first link connecting said handwheel to said input branch for moving said input branch and first and second output branches when said handwheel is moved;

(e) a second link connected to said first output branch and to said brake mechanism of the first truck;

(f) an automatic slack adjuster;

(g) a third link connected to said second output branch and to said slack adjuster;

(h) a fourth link connected to said slack adjuster and connected to said brake mechanism of the second truck;

(i) a fifth link connected to said slack adjuster and connected to said brake mechanism of said third truck; and (j) whereby movement of said handwheel operates through said force distributor to separately operate said brake mechanisms.

* * * * *